US005680008A

United States Patent [19]

Brandes et al.

[11] Patent Number: 5,680,008

[45] Date of Patent: Oct. 21, 1997

[54] COMPACT LOW-NOISE DYNODES INCORPORATING SEMICONDUCTOR SECONDARY ELECTRON EMITTING MATERIALS

[75] Inventors: George R. Brandes; John B. Miller, both of Danbury, Conn.

[73] Assignee: Advanced Technology Materials, Inc., Danbury, Conn.

[21] Appl. No.: 417,010

[22] Filed: Apr. 5, 1995

[51] Int. Cl.[6] ..... H01J 43/18

[52] U.S. Cl. ..... 313/533; 313/534; 313/103 CM; 313/105 CM

[58] Field of Search ..... 313/533, 534, 313/535, 536, 103 R, 103 CM, 104, 105 CM

[56] References Cited

U.S. PATENT DOCUMENTS

| | | | |
|---|---|---|---|
| 4,518,980 | 5/1985 | Guittard et al. | 357/30 |
| 4,628,273 | 12/1986 | Vlasak | 330/4.3 |
| 4,829,355 | 5/1989 | Munier et al. | 357/30 |
| 5,086,248 | 2/1992 | Horton et al. | 313/103 |
| 5,117,149 | 5/1992 | Fijol | 313/103 |
| 5,180,951 | 1/1993 | Dworsky et al. | 315/169.3 |
| 5,283,501 | 2/1994 | Zhu et al. | 315/169.3 |
| 5,294,577 | 3/1994 | Yamamoto et al. | 501/134 |
| 5,336,902 | 8/1994 | Nigaki et al. | 257/10 |
| 5,378,960 | 1/1995 | Tasker et al. | 313/103 CM |

OTHER PUBLICATIONS

Bekker et al., Int'l Electron Devices Meeting, 1992, Technical Digest, pp. 949–952, IEEE, New York, 1992.

Mearini et al., "Investigation of Diamond Films for Electronic Devices," Surface and Interface Anal. 21, 138–143 (1994).

Ramesham et al., "Selective Growth of Polycrystalline Diamond Thin Films on a Variety of Substrates . . . ", J. Mater. Res. 7, 1144–51 (1992).

Ramesham et al., "Growth of Polycrystalline Diamond Over Glass Carbon and Graphite Electrode Materials," J. Electrochem. Soc. 140, 3018–20 (1993).

Ramesham et al., "Effect of Hydrogen on the Properties of Polycrystalline Diamond Thin Films," Surface and Coatings Technol. 64, 81–86 (1994).

Malta et al., "Secondary Electron Emission Enhancement and Defect Contrast from Diamond . . . ," Appl. Phys. Lett. 64, 1929–31 (1994).

Palmberg, "Secondary Emission Studies on Ge and Na–covered Ge," J. Appl. Phys. 38, 2137–47 (1967).

Mearini et al., "Investigation of Diamond Films for Electronic Devices," Tri–Service/NASA Cathode Workshop, Mar. 29–31, 1994, pp. 135–138 (1994).

Mearini et al., "Fabrication of an Electron Multiplier Utilizing Diamond Films," Thin Solid Films 253, 151–6 (1994).

Bekker et al., "Investigation of Applications of Diamond Films in Microwave Tubes," May, 1992.

Joshi et al., "Role of Surface Treatments on Properties and Structure of Diamond Surfaces," Proc. Electrochem. Soc. 93–17, 613–19 (1993).

(List continued on next page.)

*Primary Examiner*—Sandra L. O'Shea
*Assistant Examiner*—Vip Patel
*Attorney, Agent, or Firm*—Eugene L. Flanagan, III; Janet Elliott

[57] ABSTRACT

This invention relates to electron emitting semiconductor materials for use in dynodes, dynode devices incorporating such materials, and methods of making the dynode devices. In particular, the invention relates to emissive materials having an electron affinity that is negative and which have low resistivity. The invention also relates to electronic devices such as electron multipliers, ion detectors, and photomultiplier tubes incorporating the dynodes comprising the materials, and to methods for fabricating the electronic devices. The secondary electron emitters of the present invention comprise wide bandgap semiconductor films selected from diamond, AlN, BN, $Ga_{1-y}Al_yN$ where $0 \leqq y \leqq 1$ and $(AlN)_x(SiC)_{1-x}$ where $0.2 \leqq x \leqq 1$. The films are preferably single crystal or polycrystalline. The films may be continuous or patterned.

33 Claims, 4 Drawing Sheets

OTHER PUBLICATIONS

Hoffman et al., "Secondary Electron Emission Spectroscopy: a Sensitive and Novel Method for the Characterization of the Near–Surface Region of Diamond and Diamond Films," Appl. Phys. Lett. 58, 361–3 (1991).

Pickett, "Negative Electron Affinity and Low Work Function Surface: Cesium on Oxygenated Diamond (100)," Phys. Rev. Lett. 73, 1664–7 (1994).

Woods et al., "An Investigation of the Secondary–Electron Emission of Carbon Samples Exposed to a Hydrogen Plasma," J. Phys. D: Appl. Phys. 20, 1136–42 (1987).

Franconi, "Secondary Electron Yield of Graphite and TiC Coatings," Fusion Technol. 6, 414–19 (1984).

Seiler, "Secondary Electron Emission in the Scanning Electron Microscope," J. Appl. Phys. 54, R1–R18 (1983).

Mearini et al., "Stable Secondary Electron Emission Observations from Chemical Vapor Deposited Diamond," Appl. Phys. Lett. 65, 2702–4 (1994).

COMPACT LOW-NOISE DYNODES INCORPORATING SEMICONDUCTOR SECONDARY ELECTRON EMITTING MATERIALS

BACKGROUND OF THE INVENTION

1. Field of the Invention

This invention relates to electron emitting semiconductor materials for use in dynodes, dynode devices incorporating such materials, and methods of making the dynode devices. In particular, the invention relates to emissive materials having an electron affinity that is negative and which have low resistivity. The invention also relates to electronic devices such as electron multipliers, ion detectors, and photomultiplier tubes incorporating the dynode devices, and to methods for fabricating the electronic devices.

2. Description of the Related Art

The purpose of a dynode device is conversion of an energetic particle, such as a photon, electron, ion or other subatomic particle, into a pulse of secondary electrons. The dynode device incorporates a secondary-electron emissive material which produces an avalanche of secondary electrons upon impact of an incident particle on the surface of the dynode. When the yield of emitted secondary electrons is greater than one electron per incident particle, electrical amplification of the incident particle occurs. A dynode device may comprise many geometric configurations of one or more discrete or continuous dynodes. In any case, it is advantageous for the dynode emissive material to have a very high secondary yield to maximize the signal amplification.

The secondary electron yield, Y, of a dynode material may be defined as the average number of electrons produced by the impingement of a primary particle onto the material. The secondary electron yield may be readily determined either by detecting the emitted electron current, $i_e$, or by measuring the current through the dynode, $i_x$, induced by the primary particle impact. As an example, when the primary particles are part of an electron current, $i_p$, the secondary electron yield is $$Y=\frac{i_e}{i_p}=\frac{i_p-i_x}{i_p}=1-\frac{i_x}{i_p}$$

The secondary electron yield is a property of a material or material system and is most properly defined for a single amplification event, or statistical aggregate of such events. The gain, G, of a dynode device, in contrast, is the product of one or more sequential amplifications produced by the primary particle. Thus $$G=Y^n$$

where n is the number of amplification events initiated by a single primary particle. In a discrete dynode device, n is exactly defined, and is the number of dynode elements. In a continuous dynode device, n is less well defined, but depends primarily on the bias voltage applied to the dynode and the physical dimensions of the dynode.

Materials which have a high secondary electron yield are typically characterized by a negative electron affinity (NEA). The electron affinity of a material is negative if the energy of the lowest-energy state of the material's conduction band is greater than the energy of an electron at rest in vacuum (the vacuum level). Many wide bandgap semiconductors and insulators have a NEA. A NEA may be induced in narrow bandgap semiconductor materials by altering the surface chemistry, thereby raising the energy of the conduction band above the vacuum level. This is commonly accomplished by heavily doping the surface region of the semiconductor and depositing electropositive elements such as Group I metals or compounds onto the surface.

Many electron emitting materials suffer several undesirable properties which limit their usefulness in dynode devices. While materials such as $SiO_2$, $Si_3N_4$, $Al_2O_3$, MgO and BaO may have an intrinsic NEA, these materials are dielectrics. Consequently, if the film is thick the material will charge during dynode operation because there are insufficient electrons in the conduction band to permit facile flow of charge and thereby compensate for the loss of the secondary electrons. Erratic gain results since the secondary electron yield is altered by the consequent presence of a surface electrical charge. The detectable incident particle flux and the gain uniformity is limited by the rate of charge neutralization.

Various other intrinsically NEA materials have been explored in an effort to address this problem. Semiconducting zinc titanate ceramic compositions, consisting of a mixture of ZnO and $TiO_2$, optionally containing $Al_2O_3$, have been disclosed for secondary electron multiplication (continuous dynode) applications. Such mixtures cannot be used for detecting charged particles over a wide range of temperatures because they have a negative temperature coefficient of resistance which can lead to "thermal runaway", and temperature-induced spontaneous electron emission. The addition of nickel oxide modifies the temperature coefficient of resistance of zinc titanium oxides, yet the resistivities of the materials remain quite high. Also, $TiC_2$ and $Al_2O_3$ are well known to be chemically reactive, particularly toward chemisorptive species, such as Lewis acidic and basic species as well as Brønsted acids.

Materials that have an induced NEA have also been used as electron sources. Such materials include p-type semiconductors, especially III–V compounds such as GaAs or $Ga_{1-y}Al_yAs$, as well as many other materials which have been coated with cesium or oxidized cesium. Emitter structures comprising cesium oxide/silver/AlGaAs, and emitter structures comprising cesium oxide/aluminum/indium phosphide layer structures are known. M. Geis has reported significant electric-field induced emission from cesium and oxygen terminated diamond (M. Geis, Proceedings of the American Physical Society March Meeting, Pittsburg, 1994 (unpublished)). The use of cesium and cesium compounds in this application is well-known.

However, materials that have an induced NEA are subject to chemical contamination and degradation, erratic secondary yield and scrubbing by the incident beam. The maximum operating temperature range of such materials is also relatively low because of the volatility of the surface cesium compounds. This volatility has also led to contamination of structures or devices incorporating dynodes, such as the photocathode of a photomulitiplier being contaminated with the Cs from the dynode surface (*Photomulitiplier Handbook* (Burle Technologies, Inc.: Lancaster, Pa., 1980) p. 74).

Electron emission may also be induced from materials or structures by the presence of an applied, attractive electrical field, i.e., a field that is oriented so that the material or structure is electrically negative relative to some anode, gate or other electrical structure. The applied field permits electrons below the vacuum level to tunnel through the surface potential barrier and thus be emitted. Materials which do not have NEA properties, such as metals like Mo and Ni, can be used as field emitters if they are incorporated within appropriate structures which greatly enhance the applied field locally, such as cones or other shapes having points. For these materials to emit, the applied field must be quite high, typically ≧50V/μm, with the effective field at the point of the structure being much higher.

It would appear that negative electron affinity materials would be ideal field emitters because electrons that diffuse to the surface are readily emitted into the vacuum. No morphological changes to enhance the field at the surface of the material would be required. The electric field would be required solely for accelerating the emitted electrons to useful energies and for focusing the emitted electrons. Negative electron affinity materials, however, are generally p-type semiconductors or if n-type, have deep donor impurity levels. Consequently, significant quantities of electrons are unlikely to be found in states at or above the vacuum level unless some sort of external excitation mechanism is applied. Materials used in field emission devices are designed or selected so that electrons are in an energy state close to the vacuum level to allow for their emission with the application of the field. This design feature of the field emission device conflicts with the dynode device requirement that electrons not be emitted unless contacted with the incident energy particle. "Noise" created by the emission of electrons due to thermal energy, for example, decreases the usefulness of the dynode if these materials are used. In general, in wide bandgap materials, the electrons are in states far from the vacuum level. The requirements for secondary electron emission materials used in dynode applications are different from those required for field emission.

It would be desirable to use as the dynode material a negative electron affinity material that does not require the addition of volatile additives such as cesium and its compounds to the surface, which is not subject to charging during operation, and which is chemically resistant and stable at high temperatures.

Accordingly, it is an object of the present invention to provide secondary-electron emissive materials, which are characterized by a NEA and have been rendered conductive for use in dynode devices. Other objects and advantages of the present invention will be more fully apparent from the ensuing disclosure and appended claims.

SUMMARY OF THE INVENTION

This invention relates to secondary electron emitting semiconductor materials for use in dynode devices, dynode devices incorporating such materials, and methods of making dynode devices. It is desirable to produce a material for use in secondary electron emission for compact, low noise dynodes. The presently disclosed materials are wide bandgap semiconducting films having a negative electron affinity selected from the group consisting of diamond, AlN, BN, $Ga_{1-y}Al_yN$ and $(AlN)_x(SiC)_{1-x}$, where $0 \leqq y \leqq 1$ and $0.2 \leqq x \leqq 1$. Preferably, the semiconducting film is doped with a p-type dopant or an n-type dopant. The film can be doped with one or more elements selected from the group consisting of Be, Mg, Zn, C, Si, S, Se, Cd, Hg, Ge, Li, Na, Sc, B, Al, N, P, Ga and As, preferably in a concentration from $10^{14}$ to $10^{21}$ atoms/cm$^3$.

As a consequence of the wide bandgap, there are effectively no electrons in the conduction band, unless they are excited to those states. Therefore, the possibility of spurious electron emissions is nearly zero. Accordingly, the dynodes of the present invention are not plagued with noise-producing thermionic electron emission.

The present invention will become more fully understood from the detailed description given hereinbelow and the accompanying drawings, which are given by way of illustration only, and thus are not to be considered as limiting the present invention.

DETAILED DESCRIPTION OF THE INVENTION, AND PREFERRED EMBODIMENTS THEREOF

Figure 1:
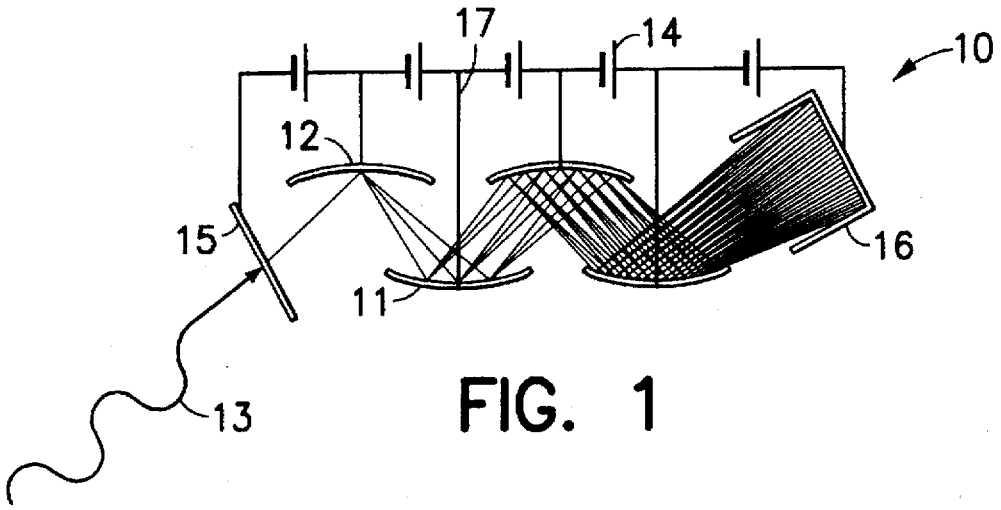
FIG. 1 is a schematic drawing of a dynode device comprising discrete dynode amplification stages.

Secondary electron multipliers must be stable under the conditions of operation including bombardment with electrons, highly energetic photons, or other accelerated charged particles. Refractory wide bandgap semiconductors such as diamond, aluminum nitride, boron nitride, aluminum nitride/silicon carbide alloys $(AlN)_x(SiC)_{1-x}$ and aluminum/gallium nitride alloys $(Al_xGa_{1-x}N)$ are attractive for this application because they are chemically inert and their wide bandgaps allow them to be used at high temperatures with low dark noise and stable yield.

The hydrogen-terminated (100), (110), (111) surfaces of diamond all possess an intrinsic negative electron affinity. Semiconducting diamond has a very high secondary electron yield and is therefore a good candidate material for use as the secondary-electron emissive material in dynode devices. Polycrystalline diamond, such as is grown by chemical vapor deposition (CVD), that exposes any or all of these faces may also be used as a dynode. In addition, because diamond is a wide bandgap semiconductor, diamond-based devices may be used at high temperatures with low dark noise and stable yield. Preferably, the secondary electron yield is greater than 2, more preferably greater than about 5 and most preferably greater than about 10.

However, undoped wide bandgap semiconductors have high resistivities, too large for use as a practical dynode material. Undoped diamond, for example, has a resistivity of $10^{10}\Omega$ cm. Wide bandgap films may be doped to make them sufficiently conductive to eliminate charging (or to reduce charging to tolerable levels). Doping may be accomplished by the addition of impurity atoms during growth of the wide bandgap semiconductor by chemical vapor deposition (CVD), by ion-implantation techniques on grown films, or by diffusion. Diffusional doping has been found to be not as advantageous in diamond. Type IIb diamond is a rare, naturally-occurring type of diamond which contains sufficient amounts of boron impurities that the diamond is made highly conductive.

Wide bandgap semiconductors may also be rendered conductive by imperfections in the lattice. These may be induced in a number of ways. If a wide bandgap semiconductor is grown on a substrate with a crystal lattice dimension different from that of the wide bandgap semiconductor, defects will be induced. The lattice may also be damaged by irradiation with energetic particles, for example, protons, high energy photons, e.g., hard x-rays, or high energy neutrons.

The surface of diamond is resistant to chemical contamination. The diamond surface is unlikely to react with the ions or ambient species present during operation in, e.g., mass spectrometers or ion detectors.

Wide bandgap semiconductors, by contrast with cesium, or cesiated surfaces, are non-volatile and will not contaminate other materials or structures in a dynode-containing device.

The secondary electron emitters of the present invention comprise wide bandgap semiconductor films selected from diamond, AlN, BN, $Ga_{1-y}Al_yN$ where $0 \leqq y \leqq 1$, and $(AlN)_x(SiC)_{1-x}$ where $0.2 \leqq x \leqq 1$. Wide bandgap semiconductors are those having bandgaps greater than about 2.2 eV, preferably greater than about 4.0 eV. The films are preferably single crystal or polycrystalline. The films may be continuous or patterned.

The orientation of the crystal surface preferably is selected to provide the largest secondary electron yield and greatest stability. The hydrogen terminated (100), (110), and (111) surfaces of the diamond crystal possess an intrinsically negative electron affinity. Measured yields from the C(100) surface were larger than the other two surfaces, while the C(111) surface was more robust. Polycrystalline films expose all of these surfaces and are useful since one or more of these surfaces are exposed. Preferably at least about 25%, more preferably at least about 50%, even more preferably at least about 75%, and most preferably at least about 100% of the surface has a (111), (110) or (100) orientation.

The surfaces of the films should be terminated in such fashion as to produce the material's negative electron affinity and to promote stability. The surface dipole should be oriented positively toward the surface. The dangling bonds of the diamond surfaces of the inventive devices are preferable hydrogen-terminated. Preferably at least about 25%, more preferably at least about 50%, even more preferably at least about 75%, and most preferably at least about 100% of the surface is hydrogen-terminated.

The C(100) or C(111) surfaces have a 1×1 or 2×1 structure. The 1×1 structure in both cases is preferred. Preferably at least about 25%, more preferably at least about 50%, even more preferably at least about 75% and most preferably about 100% of the surface has a C(100) 1×1 or a C(111) 1×1 surface structure.

Most wide bandgap materials have a resistivity too large for use as a practical dynode material. Undoped diamond, for example, has a resistivity of $10^{10}\Omega$ cm. In certain advantageous embodiments of the present invention wide bandgap material films are doped to make them sufficiently conductive that charging is eliminated (or reduced to tolerable levels). In some embodiments, doping is accomplished by the addition of impurity atoms during chemical vapor deposition (CVD) growth or by ion-implantation techniques or diffusion on grown films or bulk diamond.

In inventive embodiments having diamond secondary-electron emitters, appropriate dopants include B, Li, Na, Sc, Al, N, P and As in concentrations from $10^{14}$ to $10^{21}$ atoms/cm$^3$, with boron being preferred at concentrations to yield a resistivity of $10^1\Omega$ cm to $10^5\Omega$ cm. Dopants for BN include Li, Na, Be, Mg, Zn, C, Si, P, As, S and Se in concentrations from $10^{14}$ to $10^{21}$. Dopants for AlN and $Ga_{1-y}Al_yN$ include Li, Na, Be, Mg, Zn, Cd, Hg, C, Si, Ge, P, As, S and Se in concentrations from $10^{14}$ to $10^{21}$. Dopants for silicon carbide/aluminum nitride alloys are selected from Li, Na, Be, Mg, Zn, Cd, Hg, Ga, Ge, P, As, S, and Se in concentrations from $10^{14}$ to $10^{21}$ atoms/cc. In general p-type dopants are preferred.

Doping of the pure or impurity-atom doped materials may also be accomplished by irradiation with energetic particles, including low-energy electrons (Amano, H.; Kito, M.; Hiramatsu, K.; Aksaki, I., *Japan. J. Appl. Phys.* 28 (1989) L2112) and other radiation sources or by annealing.

These dopant species have a range of activation energies. In practice, the concentration of carriers should be adequate to provide sufficient conductivity to prevent charging. This concentration will depend on the specific wide bandgap material system selected, the degree to which the dopant is electrically active, the mobilities of charge carriers, and the geometry and current involved in the particular application.

For example, a dynode in a photomultiplier emits a typical pulse of $10^6$ electrons and the carriers should be replaced in a time less than the time between pulses, typically less than 1 microsecond (1 μs).

For all of the above materials and dopant variations, doping gradients may optionally be used to field assist carrier diffusion to the emissive surface or to decrease charge replenishment times.

The doped films may be freestanding or deposited on substrates. For dynodes utilizing the emission of back scattered secondary electrons, the films need to be sufficiently thick so that electrons stay in the films long enough to create a cloud of secondary electrons that can diffuse to the surface and escape. The depth to which an incident electron penetrates (the stopping distance) is related to the incident electron energy and the material's density. The mean implantation depth is given by $AE^{1.6}$ where $A=40$ nm·cm$^3$g$^{-1}$/D, when D=density in g/cm$^3$, and E is the incident electron energy in keV (S. Valkealahti and R. M. Nieminen, *Appl. Phys.* A 35, 57 (1984)). The likelihood that secondary electrons created by the incident electron could escape is a function of their mobility, the crystalline perfection of the film, temperature, and their lifetimes in the conduction band. As practical matter, for typical incident electron energies used in dynode applications, the doped films should be thicker than 10 nanometers, and preferably thicker than 100 nm. The upper limit on the film's thickness is dictated by other practical considerations such as weight, cost, defect variation with film thickness, difficulty in growing thick diamond films, etc.

Suitable substrates include a wide range of materials which can include semiconductors, metals, and insulators, subject to the limitation that the material must be resistant to degradation during the growth of the NEA wide bandgap material. Growth temperatures for diamond, for example, are typically above 400° C. and below 1000°, with 800°–900° C. preferred, and so the substrate material must be stable at these elevated temperatures in the growth atmosphere. The diamond growth atmosphere, for example, typically comprises a hydrocarbon such as methane, hydrogen, and any dopant gases. Silicon, copper, titanium carbide, silicon carbide, molybdenum, chromium, cobalt, iron and nickel have all been used successfully as substrates for diamond growth. Sapphire and SiC have been used successfully for growth of $Ga_{1-y}Al_yN$. Contacts must be formed to the NEA material, but that does not limit substrates to conductive materials, since contacts can be made directly to the wide bandgap semiconductor with a variety of geometries.

Interactions of an incident electron with the hydrogen terminated diamond surface can lead to hydrogen desorption. In turn, the loss of hydrogen results in decreased secondary electron yield. As the secondary electron yield from a diamond dynode gradually decreases through use, it can be regenerated by exposing the diamond surface to atomic hydrogen or a hydrogen plasma. Operating the dynode in a hydrogen atmosphere will ensure a stable yield (Bekker, T. L.; Dayton, J. A., Jr.; Gilmour, A. S. Jr.; Krainsky, I. L.; Rose, M. F.; Rameshan, R.; File, D.; Mearini, G.; *IEEE IEDM Tech. Dig.*, 37.3.1–37.3.4 (1992)).

The addition of small amounts (<1 Å, less than ⅓ monolayer) of an electropositive element, e.g., Ti or Ni, to a hydrogen-free diamond surface resulted in materials with increased NEA. (J. van der Weide, et al., *Phys. Rev.* B 50, 5803 (1994)). Therefore, coating the diamond surface with an extremely thin coating of a non-volatile, electropositive element or elements such a Sc, Pt, or Zr can be used to not only stabilize the surface, but also enhance the NEA.

The metal to be used for optionally coating the surface of the dynode material for stabilization and/or NEA enhancement should be non-volatile and adherent to the dynode material surface. These include the transition metals from groups IIIA to VIIIA, with Sc, Ti, Zr, Ni, Pd and Pt preferred. The so-called lanthanide elements are also appropriate surface coating metals, especially La and Ce.

In addition, the secondary electron emission of the dynode material may be further enhanced by adding cesium or cesium compounds to the surface using well-known techniques.

Devices incorporating these dynodes and dynode devices include electron multipliers, ion detectors, other charged particle detectors, photomultiplier tubes and photodetectors. Other devices include electron emission sources, photoemission sources and vacuum microelectronic amplifiers. Because of the stability and low noise provided by the wide bandgap materials used, these dynode devices are useful for detectors operating in low and variable count rate applications, devices that are used in high radiation environments and high temperature environments. Because of their high gain, they are useful in fast photomultiplier tubes as well. They may be useful for regenerable dynodes.

Some of the applications of the presently disclosed invention are:

- Laser Radar: Atmosphere measurements and range finding; low noise, high gain PMTs are essential to detecting the scattered UV or visible light signal.
- Pollution Monitoring: Light or particle scattering is used to detect the presence of contaminants in the atmosphere. A stable, low dark-noise PMT is needed to accurately determine low concentrations.
- Absorption and Emission Spectroscopy: High stability, low dark current, high current photomultiplier tubes are needed for Raman, UV/Visible/IR and fluorescence spectrometers.
- Medicine: Positron emissions tomography (PET) is used to image chemically active regions by detecting collinear annihilation gamma rays. Fast PMTs with high energy resolution are needed for this application.

FIG. 1 schematically depicts a dynode chain 10 which includes discrete dynode structures 11, which may be free-standing films of secondary electron emissive materials of the present invention, or may be substrates coated with films of these materials. One amplification step 12 per incident particle 13 occurs. The discrete wide bandgap semiconductor dynode may be of any arbitrary shape, including concave, convex, planar or any combination thereof. A dynode device may be made of one or more of these discrete dynode elements arranged in series. Each subsequent dynode element is biased positive relative to the preceding stage 14. Electrode 17 is in conductive contact with the dynode structure (II). The device may optionally contain an initial detection element 15, such as a photocathode, neutron detection element or similarly functioning structure. The device may also optionally contain an element 16 used to detect the event that causes the electron pulse emitted by the final dynode in the series. Optionally, element 16 comprises an anode, and preferably further comprises a dynode. Preferably the system is contained in a vacuum.

Figure 2:
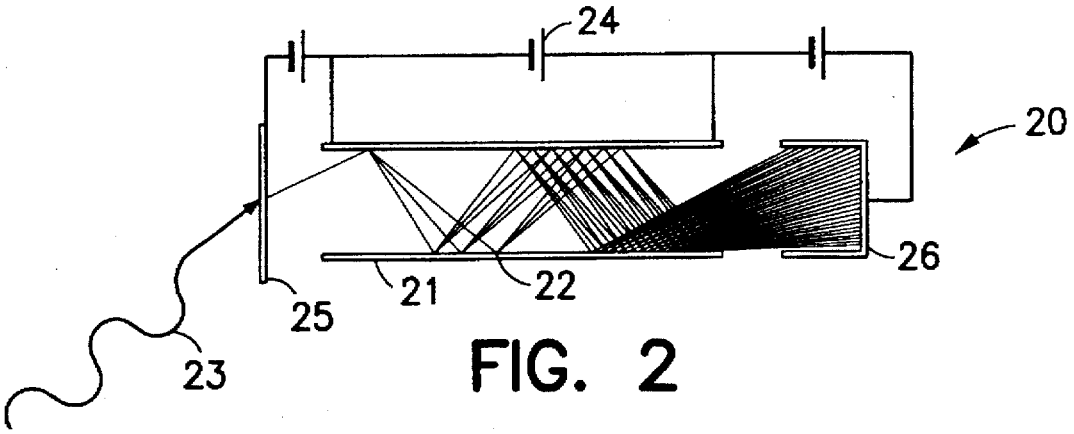
FIG. 2 is a schematic drawing of a dynode device comprising a continuous dynode structure.

FIG. 2 schematically depicts a continuous dynode device 20 incorporating a continuous dynode 21 wherein one or more amplification steps 22 per incident particle 23 may occur. The continuous wide bandgap semiconductor dynode may be of any arbitrary shape having at least one internal surface. The continuous dynode may be configured as a cylinder having a wide bandgap semiconductor coating on its interior for secondary electron amplification. A bias voltage 24 is applied across the dynode element, producing a potential gradient. The continuous dynode device may optionally contain an initial detection element 25, such as a photocathode, neutron detection element or similarly functioning structure. The device may also optionally contain an element 26 used to detect the electron pulse emitted by the continuous dynode. Preferably the system is contained in a vacuum.

Figure 3:
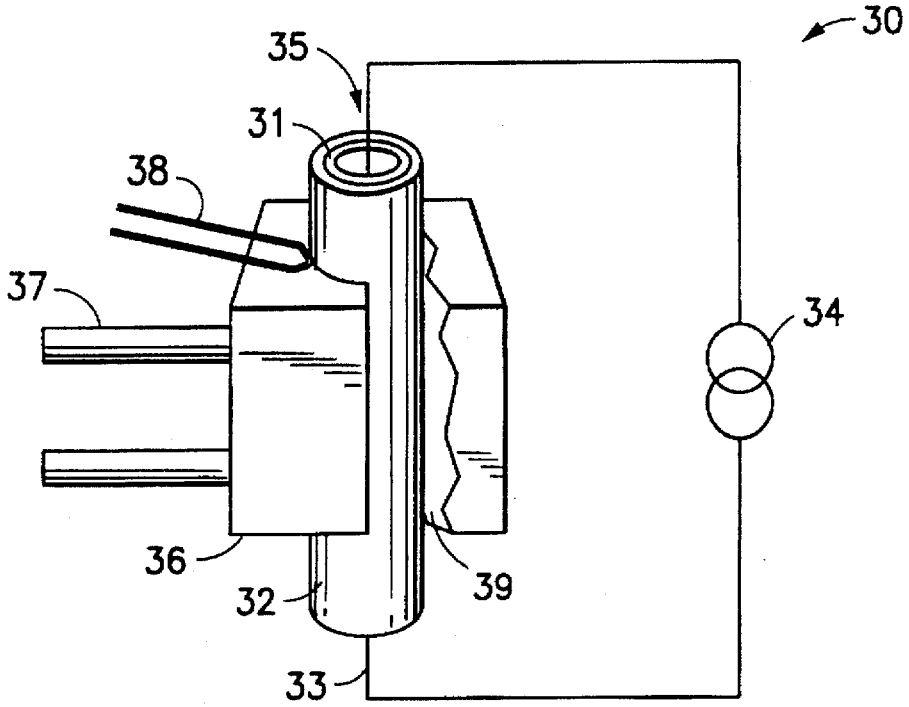
FIG. 3 schematically depicts the manufacture of a continuous wide bandgap semiconductor dynode as a single component.

FIG. 3 schematically shows a reactor configuration 30 suitable for manufacturing a continuous diamond dynode consisting of a single cylindrical element. A diamond film 31 is grown on the internal surface of an appropriate substrate, such as a ceramic tube 32 or other hollow item. This is achieved by threading the substrate tube 32 over an appropriate metal filament 33, e.g., tungsten. The filament is heated by a current source 34 and a suitable gas mixture is passed through the tube over the hot filament by gas delivery means 35. The gas mixture should contain hydrogen, a carbon containing gas such as methane, and dopant source gas. The temperature of the tube should be controlled so that the internal surface, where diamond growth occurs, is in the range of about 400° C. to about 1000° C., and preferably about 800° C. to about 900° C. To meet this requirement, a heat transfer assembly 36 with optional cooling medium inlet and outlet ports 37 and a thermocouple or other temperature sensing device 38 may be required. The heat transfer assembly 36 is shown partially cut away at 39 to more fully illustrate the substrate tube 32 therein.

Figure 4A:
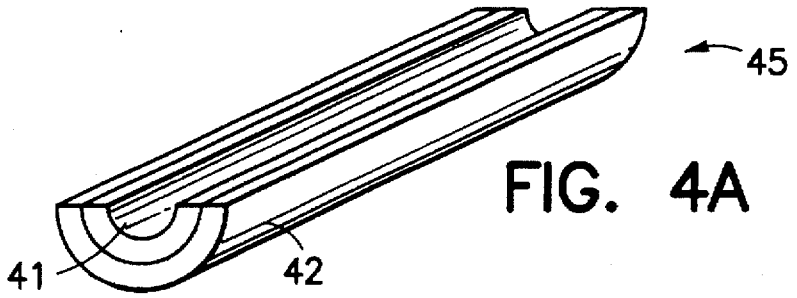
FIG. 4 is a schematic representation of the manufacture of a continuous wide bandgap semiconductor dynode produced from multiple components.
Figure 4B:
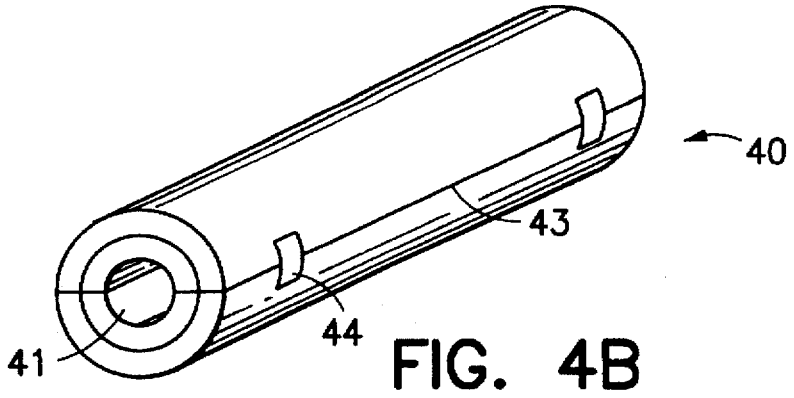

FIG. 4B shows a continuous dynode structure 40 assembled from individual elements 45 (See FIG. 4A). A wide bandgap semiconductor film 41 is grown on one surface of an appropriate substrate 42 which may be curved, planar or a complex shape. Two or more of the wide bandgap semiconductor-coated pieces are assembled with the wide bandgap semiconductor surfaces proximal and in opposition. The seam 43 between the components need not be flush, as internal electrostatic focusing by the dynode components or by external focusing elements may be sufficient to provide for containment of secondary electrons to provide uniform, stable gain. However, the dynode components should be electrically connected 44.

Figure 5A:
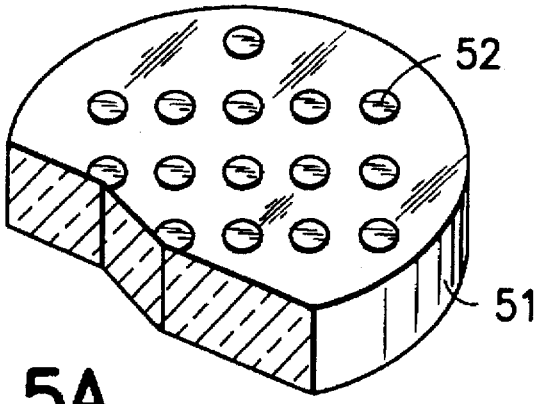
FIG. 5 shows a schematic cross-sectional perspective depiction of the manufacture of a wide bandgap semiconductor dynode device comprised of an array of continuous dynodes.
Figure 5B:
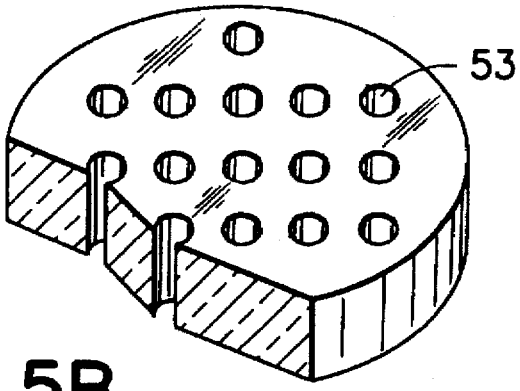
Figure 5C:
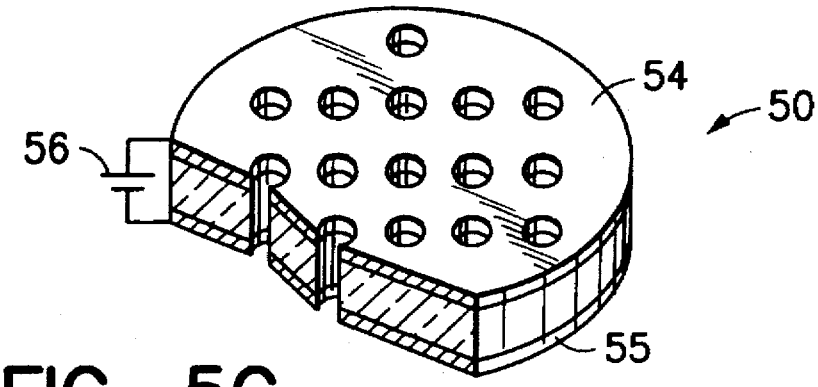

Yet another dynode structure incorporating the electron emissive materials of the present invention is a two-dimensional array of discrete or continuous dynodes 50 shown in FIG. 5. The current invention discloses a method for manufacturing such a continuous diamond dynode array from a single-crystal diamond or from a monolithic polycrystalline diamond. Metal pads 52 are deposited onto the surface of an undoped diamond single crystal or monolithic polycrystalline diamond sample 51 (FIG. 5(A)). The pads may be made of Ni, Fe, Pt, or other metal which is a weak carbide forming metal and which has a low carbon solubility. The ratio of the diamond thickness to the metal pad diameter may range from 2–100 with 20–40 preferred. The metal-diamond assembly is then heated in an atmosphere of hydrogen gas at temperature from 800°–1000° C., with an optimum range being 895°–950° C. This procedure will produce holes 53 in the diamond by catalytic etching (FIG. 5(B)). Any residual metal and graphitized diamond is then removed by any of a variety of well-known chemical processes. Suitably conductive diamond is grown in the channels and on the outer surfaces by conventional means. Opposing electrical contacts 54, 55 are then applied to the surfaces of the device so that a bias voltage 56 may be applied for device operation. Preferably the system is contained in a vacuum.

Figure 6:
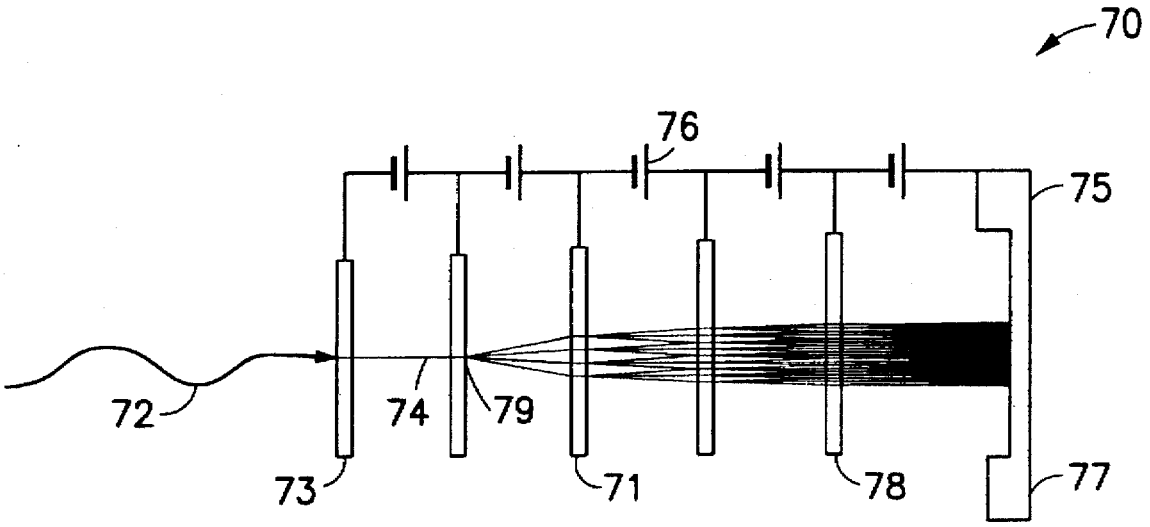
FIG. 6 shows a schematic drawing of a dynode device comprising a plurality of parallel plate electron multipliers.

FIG. 6 schematically depicts a dynode comprising an electron multiplier array 70 formed of a plurality of parallel transmission electron multiplier dynodes 71 arranged in serial configuration. The incident particle 72 is received at an initial transmission element 73 which transmits at least one emitted secondary electron 74 to the first dynode. One amplification step 79 per secondary electron 74 occurs. The electron(s) are accelerated toward each subsequent dynode and to the anode 75 as each subsequent dynode element is biased positive relative to the preceding stage 76. The device may also optionally contain an element 77 used to detect the event causing the electron pulse emitted by the final dynode 78 in the series. Additionally, optionally the initial transmission element 73 can be a photo cathode, neutron detection element or similarly functioning structure. Preferably, the system is contained in vacuum.

The dynodes may be used as discrete amplification stages [see FIGS. 1 and 6]. The dynodes may also be used for continuous amplification [see FIG. 2]. The dynodes may also be arranged in an array, either as individual elements or as a monolithic device [see FIG. 5].

The features and advantages of the invention are more fully illustrated by the following non-limited examples, wherein all parts and percentages are by mass, unless otherwise expressly stated.

EXAMPLE 1

Secondary Electron Yields from Oriented Diamond Films

Homeopitaxial diamond films were grown on clean, oriented single-crystal diamond substrates by hot-filament assisted chemical vapor deposition from dilute methane in hydrogen gas mixtures in a stainless steel growth chamber pumped by a mechanical pump. A tungsten filament was supported over the substrate at a distance of approximately 10–15 mm. Gas flow into the reactor was controlled by mass flow controllers, and the pressure in the reactor during growth was controlled by pumping through a leak valve. Growth conditions were:

Filament Temperature=2050° C.

Substrate Temperature≈900° C.

Gas Composition: 0.5% $CH_4$ in $H_2$

Pressure=10 torr.

Boron doping was accomplished by adding $B_2H_6$ to the source gas stream at boron/carbon ratios ranging from 0.05% to 6%.

The secondary electron yields from the grown diamond film samples were measured in a vacuum chamber equipped with a spherical retarding grid analyzer and an electron gun. The measured yields produced by 1000 eV incident electrons striking (100), (110) and (111)-oriented, single-crystal, boron-doped diamond films, each with a boron concentration of ~$2\times10^{20}$ atoms/cm$^3$, are set out below, and compared with yields measured in the same system of a copper beryllium oxide ("Cu-BeO") dynode element taken from a commercial photomultiplier tube. The yield of the CuBeO element may have been altered by air exposure, but the yield we measured is typical for this material.

| Diamond Crystal Orientation | Secondary Electron Yield |
|---|---|
| (100) | 10.1 |
| (110) | 9.7 |
| (111) | 8.3 |
| Cu—BeO | 3.1 |

EXAMPLE 2

Secondary Electron Yields from Polycrystalline Diamond Films

Polycrystalline diamond films were grown as described in Example 1 on non-diamond substrates, including Si(100), SIC(0001), SIC(000$\bar{1}$), SIC(01$\bar{1}$0), Cu foil, Fe foil, Mo foil, and Ni foil. The boron concentration was ~$10^{20}$ atoms/cm$^3$. Secondary electron yields were measured and are shown below. Also shown is the secondary electron yields from undoped polycrystalline diamond grown on Mo foil reported by Bekker et al. (op. cit.), as measured in a different apparatus.

| Substrate | Secondary Electron Yield |
|---|---|
| Si(100) | 8.7 |
| SiC(0001) | 8.7 |
| Cu | 9.9 |
| Fe | 5.6 |
| Mo (Bekker et al.) | 12.7 |

EXAMPLE 3

Secondary Electron Yields vs. Boron Concentration

Polycrystalline diamond films were grown as described in Example 1 on diamond (100), (110), (111) and Si (100). The boron concentration ranged from $10^{19}$–$10^{21}$ atoms/cm$^3$. Secondary electron yields were measured from the doped diamond films and from undoped type IIa natural diamond single crystals using an incident electron energy of 1000 eV. The secondary electron yield results are shown below. Secondary electron yield increases with dopant concentration, reaches a maximum, and then decreases.

| Substrate | Boron Concentration (atoms/cm$^3$) | Secondary Electron Yield |
|---|---|---|
| ◊(100) | $\leqq 5 \times 10^{15}$ | 3.0 |
| ◊(100) | $5 \times 10^{19}$ | 10.1 |
| ◊(100) | $3 \times 10^{20}$ | 6.7 |
| ◊(110) | $\leqq 5 \times 10^{15}$ | 2.7 |
| ◊(110) | $4 \times 10^{19}$ | 9.7 |
| ◊(110) | $5 \times 10^{20}$ | 9.2 |
| ◊(110) | $1 \times 10^{21}$ | 7.8 |
| ◊(111) | $1 \times 10^{20}$ | 8.7 |
| ◊(111) | $3 \times 10^{20}$ | 7.3 |
| ◊(111) | $2 \times 10^{21}$ | 5.6 |
| Si(100) | $\sim 6 \times 10^{19}$ | 6.0 |
| Si(100) | $\sim 2 \times 10^{20}$ | 8.7 |
| Si(100) | $\sim 6 \times 10^{20}$ | 6.0 |

EXAMPLE 4

The Energy Distribution of Secondary Electrons

Boron-doped diamond (111) and (110) films were prepared s in Example 1. The energy distributions, n(E), of the secondary electrons emitted from the samples were ascertained by varying the grid potential of a retarding grid analyzer in the following way. The current at the sample, $i_x$, is the sum of all the electrons with energy less than the potential of the retarding grid:

$$i_x \propto \int_{-\infty}^{eV_g} n(E)dE.$$

By measuring the current at the sample as a function of the grid bias, varying $V_g$, and then differentiating the sample current with respect to the grid bias, the energy distribution of the electrons which are emitted from the surface may be determined:

$$n(E) \propto -\frac{di_x(V_g)}{dV_g}.$$

Figure 7:
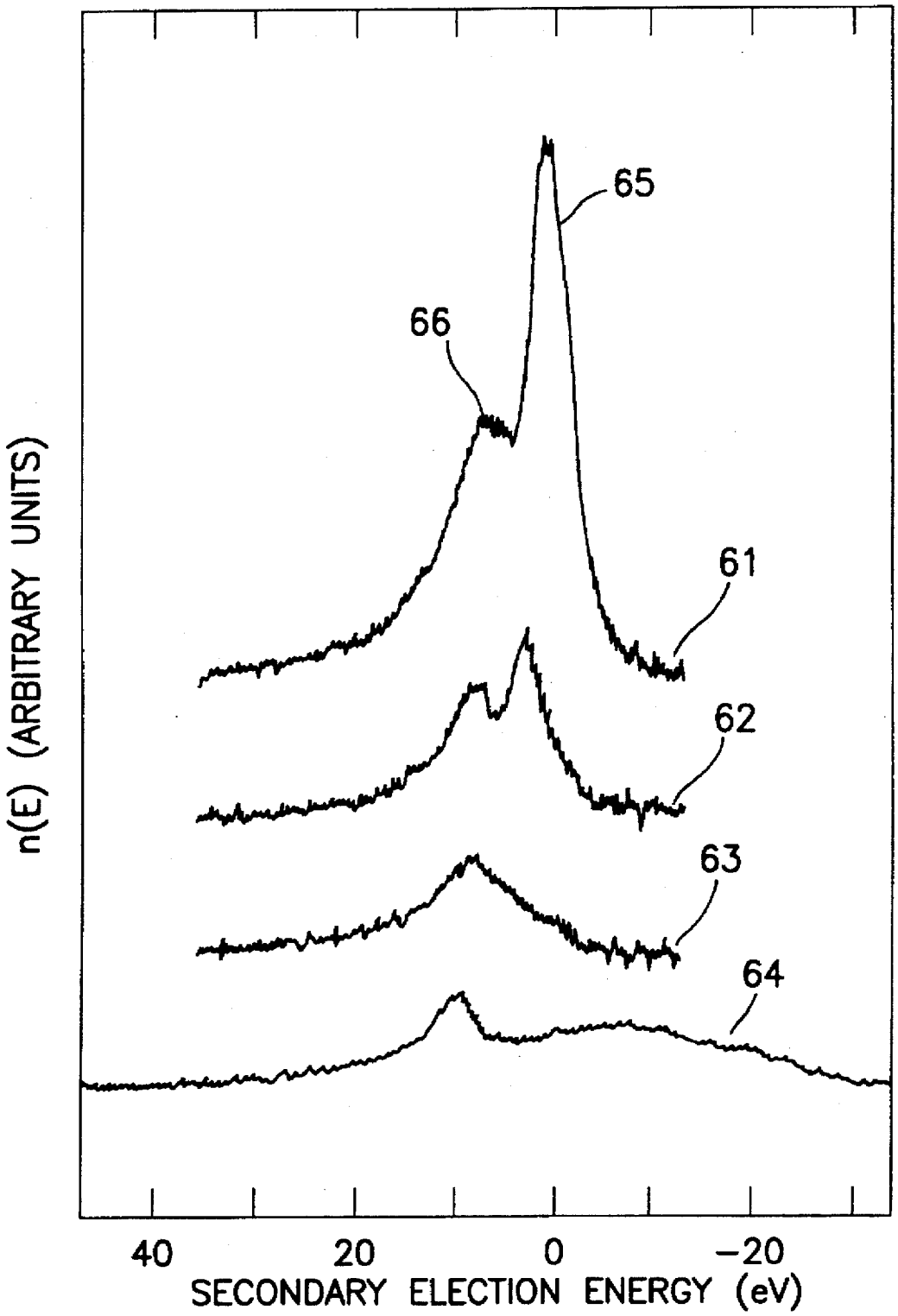
FIG. 7 is a plot of the number of secondary electrons emitted vs. energy of the emitted electrons for diamond doped with boron at low dopant concentrations, undoped natural diamond and a Cu-BeO dynode element.

Referring now to FIG. 7, the distributions of secondary electrons from (111) boron-doped NEA diamond 61, from (110) boron-doped NEA diamond 62, from (110) boron-doped diamond which has had its NEA properties reduced 63 as described in Example 5, and from CuBeO 64. All of the electron distributions are plotted on the same scale. The secondary electron populations from the NEA diamond samples are much more intense that the other two samples. In addition, the full-width at half maximum (FWHM) of the secondary electron populations emitted from diamond is ≦12 eV, while the FWHM of the secondary electrons emitted from CuBeO is >40 eV. Thus the secondary electrons emitted from diamond will be more focusable or will suffer less temporal dispersion of the electron pulse than will those emitted from CuBeO.

The (111) boron-doped diamond trace is particularly illustrative of the secondary electrons emitted by an NEA material. The secondary electrons consist of two populations, hence the bimodal distribution. The lower energy population 65, peaking at ~1 eV, are emitted from near the conduction band minimum; these are the NEA electrons. The higher energy population 66, peaking at ~8 eV, are electrons which have not been fully thermalized prior to emission from the diamond surface.

EXAMPLE 5

Secondary Electron Yield as a Function of Electron Fluence

Oriented, boron-doped diamond films were grown as in Example 1 and the secondary electron yield was measured as a function of the electron fluence to the surface. The secondary electron yield from CuBeO was similarly measured. The incident electron beam energy was 1000 eV at a particle flux of ~64 μA/cm$^2$. The flux was constant; the fluence was the product of the time and the electron flux. The secondary electron yield decreased with increasing electron fluence. The yield from CuBeO decreased more rapidly than from diamond.

| | Secondary Electron Yield | | | |
|---|---|---|---|---|
| Electron Fluence (mA-s/cm$^2$) | CuBeO | B-doped Diamond (100) | B-doped Diamond on Si(100) | B-doped Diamond on Cu foil |
| 0 | 3.1 | 10.1 | 8.8 | 9.9 |
| 76 | 2.1 | 8.2 | 7.7 | 8.2 |
| 134 | 1.8 | 7.2 | 7.2 | 7.4 |
| 172 | 1.6 | 6.4 | 6.8 | 6.6 |
| 210 | 1.4 | 5.6 | 6.3 | 6 |
| 248 | 1.3 | 4.9 | 6.0 | 5.3 |

A decrease in the NEA properties of the diamond was the cause of the decrease in secondary electron yield upon extended exposure to the 1000 eV electron beam. The electron beam may cause hydrogen desorption and/or change the surface structure. The NEA properties may be regenerated by exposure of the diamond surface to hydrogen atoms or a hydrogen plasma (See van der Weide, J.; Nemanich, R. J. *Appl. Phys. Lett.* 62 (1993) 1878).

As described in Example 4, the secondary electron distribution of a (110) diamond film 62 is shown in FIG. 7. The secondary electron distribution of the same film is shown after a fluence of 248 mA-s/cm$^2$. The peak resulting from the NEA electrons 65 has essentially disappeared, leaving only the peak resulting from emission of non-thermalized electrons 66.

EXAMPLE 6

Manufacture of a Continuous Diamond Dynode Array by Metal Etching

Referring to the schematic of FIG. 5, metal pads 52 are deposited onto the surface of a single crystal or monolithic polycrystalline diamond sample 51. The diamond is undoped or lightly doped. The pads may be made of Ni, Fe, Pt, or other metal which is weak carbide forming metal and which has a low (<ca. 20 wt %) carbon solubility. The ratio of the diamond thickness to the metal pad diameter may range from 2–100 with 20–40 preferred. The metal-diamond assembly is then heated in an atmosphere of hydrogen gas at temperatures from 800°–1000° C., with an optimum range being 895°–950° C. This procedure will produce holes 53 in the diamond by catalytic etching. Residual metal is then dissolved with appropriate chemical reagents. Etches for the metals employed herein are well-known in the art. However, included as examples, is the removal of: Ni by an 38°–42° Baumé aqueous solution of $FeCl_3$, the dissolution of Fe by aqueous HCl, and the removal of Pt by aqua regia (a 3:1 solution of concentrated $HNO_3$ and concentrated HCl).

The resulting perforated diamond structure is then cleaned by sequentially etching in a boiling solution of $H_2SO_4/CrO_3/H_2O$ to remove any graphitized diamond, immersing in a 1:1 solution of concentrated $NH_4OH$ and 30% $H_2O_2$ at –60° C., and dipping in aqueous HF. Alternatively, but equally effective diamond cleaning procedures are well-known in the art for removing traces of residual metal and graphitized diamond.

The cleaned, perforated diamond is optionally exposed to an atomic-hydrogen flux, produced by passing $H_2$ over a heated tungsten or rhenium filament or gauze at reduced pressure, e.g., <50 torr. Alternatively, the atomic hydrogen is produced by plasma techniques.

The surfaces of the diamond structure are subsequently coated with an appropriately doped thin layer of semiconductive diamond.

Opposing electrical contacts 54, 55 are then applied to the surfaces of the device so that a bias voltage 56 may be applied for device operation.

EXAMPLE 7

Manufacture of a Continuous Diamond Dynode Array by Laser Drilling

Referring again to the schematic of FIG. 5, holes 53 are drilled through a single crystal or monolithic polycrystalline diamond sample 51 by a high-power laser. The ratio of the diamond thickness to the hole diameter may range from 2–100 with 20–40 preferred.

The resulting perforated diamond structure is then cleaned, optionally exposed to atomic hydrogen, coated with an appropriately doped semiconducting diamond layer, and electrical contacts applied as described in Example 6.

EXAMPLE 8

Manufacture of a Continuous Diamond Dynode Array by Ion Milling

Referring to the schematic in FIG. 5, holes 53 are drilled through a single crystal or monolithic polycrystalline diamond sample 51 by an energetic ion-beam mill. The ratio of the diamond thickness to the hold diameter may range from 2–100 with 20–40 preferred.

The resulting perforated diamond structure is then cleaned, optionally exposed to atomic hydrogen, coated with an appropriately doped semiconducting diamond layer, and electrical contacts applied as described in Example 6.

While the invention has been described herein with reference to specific aspects, features, and embodiments, it will be apparent that other variations, modifications, and embodiments are possible, and all such variations, modifications and embodiments therefore are to be regarded as being within the spirit and scope of the invention.

What is claimed is:

1. A dynode device comprising a secondary electron emitting material wherein said material is a semiconducting film having a negative electron affinity selected from the group consisting of diamond, AlN, BN, $Ga_{1-y}Al_yN$ and $(AlN)_x(SiC)_{1-x}$, where $0 \leqq y \leqq 1$ and $0.2 \leqq x \leqq 1$ and the film is doped with one or more elements selected from the group consisting of Be, Mq, Zn, C, Si, S, Se, Cd, Hg, Ge, Li, Na, Sc, B, Al, N, P, Ga and As in a concentration from $10^{14}$ to $10^{21}$ atoms/cm$^3$.

2. A dynode device according to claim 1, further comprising an electrode in conductive contact with the film for conducting electric current from the film.

3. A dynode device according to claim 2, wherein the electrode comprises a substrate for the film.

4. A dynode device according to claim 3, wherein the substrate is a single crystal.

5. A dynode device according to claim 4, wherein the substrate comprises a material selected from the group consisting of silicon, molybdenum, chromium, copper, titanium carbide, silicon carbide, sapphire, nickel, iron and cobalt.

6. A dynode device according to claim 1, wherein the film is continuous.

7. A dynode device according to claim 1, wherein the film is patterned.

8. A dynode device according to claim 1, wherein the film has a thickness of about 0.01 microns to about 1000 microns.

9. A dynode device according to claim 1, wherein the film is doped with a p-type dopant.

10. A dynode device according to claim 1, wherein the film is doped with an n-type dopant.

11. A dynode device according to claim 1, wherein the film has a secondary electron emitting surface having a surface dipole oriented positively toward the surface.

12. A dynode device according to claim 1, wherein the film is a semiconducting diamond film having a secondary electron yield of at least about two.

13. A dynode device according to claim 1, wherein the film is single crystal.

14. A dynode device according to claim 1, wherein the film is polycrystalline.

15. A dynode device according to claim 1, wherein the film has a secondary electron emitting surface which is curved.

16. A dynode device according to claim 1, wherein the film has a secondary electron emitting surface which is flat.

17. A dynode device according to claim 1, wherein the film is a coating on an inner surface of a tube.

18. A dynode device according to claim 1, in combination with an anode positioned with respect to the dynode device to receive at least one secondary emitted electron therefrom.

19. A dynode device according to claim 18, wherein the anode comprises a further dynode.

20. A dynode device according to claim 1, in combination with a photocathode, positioned with respect to the dynode device to emit at least one electron toward the dynode device in response to a photon incident on the surface of the photocathode, and an anode positioned with respect to the dynode device to receive at least one secondarily emitted electron therefrom.

21. A dynode device according to claim 20, wherein the anode comprises a further dynode device.

22. A dynode device according to claim 20, wherein the anode comprises a phosphor.

23. A dynode device comprising a secondary electron emitting material wherein said material is a semiconducting diamond film having a negative electron affinity, the film being doped with one or more elements selected from the group consisting of B, Li, Na, Sc, Al, N, P and As in a concentration from $10^{14}$ to $10^{21}$ atoms/cm$^3$.

24. A dynode device according to claim 12, wherein the doping element is B.

25. A dynode device according to claim 24, wherein the film is doped with B to yield a room temperature resistivity of $10^1\Omega$ cm to $10^5\Omega$ cm.

26. A dynode device comprising a secondary electron emitting material wherein said material is a semiconducting BN film having a negative electron affinity, the film being doped with one or more elements selected from the group consisting of Li, Na, Be, Mg, Zn, C, Si, P, As, S and Se in a concentration from $10^{14}$ to $10^{21}$ atoms cm$^3$.

27. A dynode device comprising a secondary electron emitting material wherein said material is a semiconducting film having a negative electron affinity selected from the group consisting of AlN and $Ga_{1-y}Al_yN$, where $0 \geqq y \geqq 1$, the film being doped with one or more elements selected from the group consisting of Li, Na, Be, Mg, Zn, Cd, Hg, C, Si, Ge, P, As, S, and Se in a concentration from $10^{14}$ to $10^{21}$ atoms/cm$^3$.

28. A dynode device comprising a secondary electron emitting material wherein said material is a semiconducting $(AlN)_x(SiC)_{1-x}$ film having a negative electron affinity and wherein $0.2 \leqq x \geqq 1$, the film being doped with at least one or more elements selected from the group consisting of Li, Na, Be, Mg, Zn, Cd, Hg, Ga, Ge, P, As, S, and Se.

29. A dynode device according to claim 28, wherein the film is doped with the doping element in a concentration from $10^{14}$ to $10^{21}$ atoms/cm$^3$.

30. A dynode device comprising a secondary electron emitting material wherein said material is a semiconducting diamond film having a negative electron affinity, the film being doped with one or more elements selected from the group consisting of B, Li, Na, Sc, Al, N, P and As, the diamond film having a secondary electron emitting surface and wherein at least 75% of the surface has a (111), (110) or (100) orientation.

31. A dynode device comprising a secondary electron emitting material wherein said material is a semiconducting diamond film having a negative electron affinity, the film being doped with one or more elements selected from the group consisting of B, Li, Na, Sc, Al, N, P and As, the diamond film having a secondary electron emitting surface and wherein at least about 25% of the surface has a (100) 1×1 structure or a (111) 1×1 structure.

32. A dynode device comprising a secondary electron emitting material wherein said material is a semiconducting diamond film having a negative electron affinity, the film being doped with one or more elements selected from the group consisting of B, Li, Na, Sc, Al, N, P and As, the diamond film having a secondary electron emitting surface and at least about 50% of the surface being hydrogen-terminated.

33. A dynode device comprising a secondary electron-emitting material wherein said material is a semiconducting film having a negative electron affinity selected from the group consisting of diamond, AlN, BN, $Ga_{1-y}Al_yN$ and $(AlN)_x(SiC)_{1-x}$, where $0 \leqq y \leqq 1$ and $0.2 \leqq x \leqq 1$, wherein the film is free-standing.

* * * * *